US008561249B1

(12) United States Patent
Malakova et al.

(10) Patent No.: US 8,561,249 B1
(45) Date of Patent: Oct. 22, 2013

(54) MULTI-HEAD TOOTHBRUSH ASSEMBLY

(76) Inventors: Alevtina Malakova, Forest Hills, NY (US); Boris Fuzaylov, Forest Hills, NY (US)

( * ) Notice: Subject to any disclaimer, the term of this patent is extended or adjusted under 35 U.S.C. 154(b) by 12 days.

(21) Appl. No.: 13/301,895

(22) Filed: Nov. 22, 2011

(51) Int. Cl.
*A46B 7/04* (2006.01)

(52) U.S. Cl.
USPC ..... 15/167.1; 15/184; 15/176.6; 15/194

(58) Field of Classification Search
USPC ..... 15/167.1, 184
IPC ..... A46B 7/04
See application file for complete search history.

(56) References Cited

U.S. PATENT DOCUMENTS 5,144,712 A * 9/1992 Hansel et al. ..... 15/167.1
5,875,510 A 3/1999 Lamond et al.
5,901,404 A * 5/1999 Lin ..... 15/184
5,984,550 A 11/1999 Chuang
6,138,316 A 10/2000 Weihrauch
6,487,748 B1 12/2002 Dardar et al.
6,551,265 B1 4/2003 Miguel
6,775,875 B2 8/2004 Ornelas et al.
D526,787 S 8/2006 Jandro et al.
2010/0037408 A1 2/2010 Brown

* cited by examiner

*Primary Examiner* — Monica Carter
*Assistant Examiner* — Stephanie Berry

(57) ABSTRACT

A multi-head toothbrush assembly includes a housing that is elongated and has a first end, a second end and a perimeter wall. The first end comprises an exit door. Each of a plurality of spaced sets of bristles is attached to and extends upwardly from a top side of an elongated panel. A plurality of panel sections is defined between adjacent ones of the sets. Each of the panel sections and an adjacent set defines a head. A frangible area in the panel is formed at junctures of each of the heads to facilitate breaking the heads off from one another. The panel is slidable outwardly through the first end to expose the heads and allow the heads to be used for brushing teeth. The heads are broken off of the panel to allow a next one of the heads to be used.

8 Claims, 7 Drawing Sheets

MULTI-HEAD TOOTHBRUSH ASSEMBLY

BACKGROUND OF THE DISCLOSURE

Field of the Disclosure

The disclosure relates to toothbrush devices and more particularly pertains to a new toothbrush device for providing a plurality of brushing heads positioned within a single handle.

SUMMARY OF THE DISCLOSURE

An embodiment of the disclosure meets the needs presented above by generally comprising a housing that is elongated and has a first end, a second end and a perimeter wall attached to and extending between the first and second ends. The first end comprises an exit door configured for opening or closing the first end. An elongated panel has a top side and a bottom side. Each of a plurality of spaced sets of bristles is attached to and extends upwardly from the top side. A plurality of panel sections is defined between adjacent ones of the sets. Each of the panel sections and an adjacent set defines a head. A frangible area in the panel is formed at junctures of each of the heads to facilitate breaking of the panel to allow the heads to be broken off from each other. The panel is slidable outwardly through the first end to expose the heads and allow the heads to be used for brushing teeth. The heads are broken off of the panel to allow a next one of the heads to be used.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
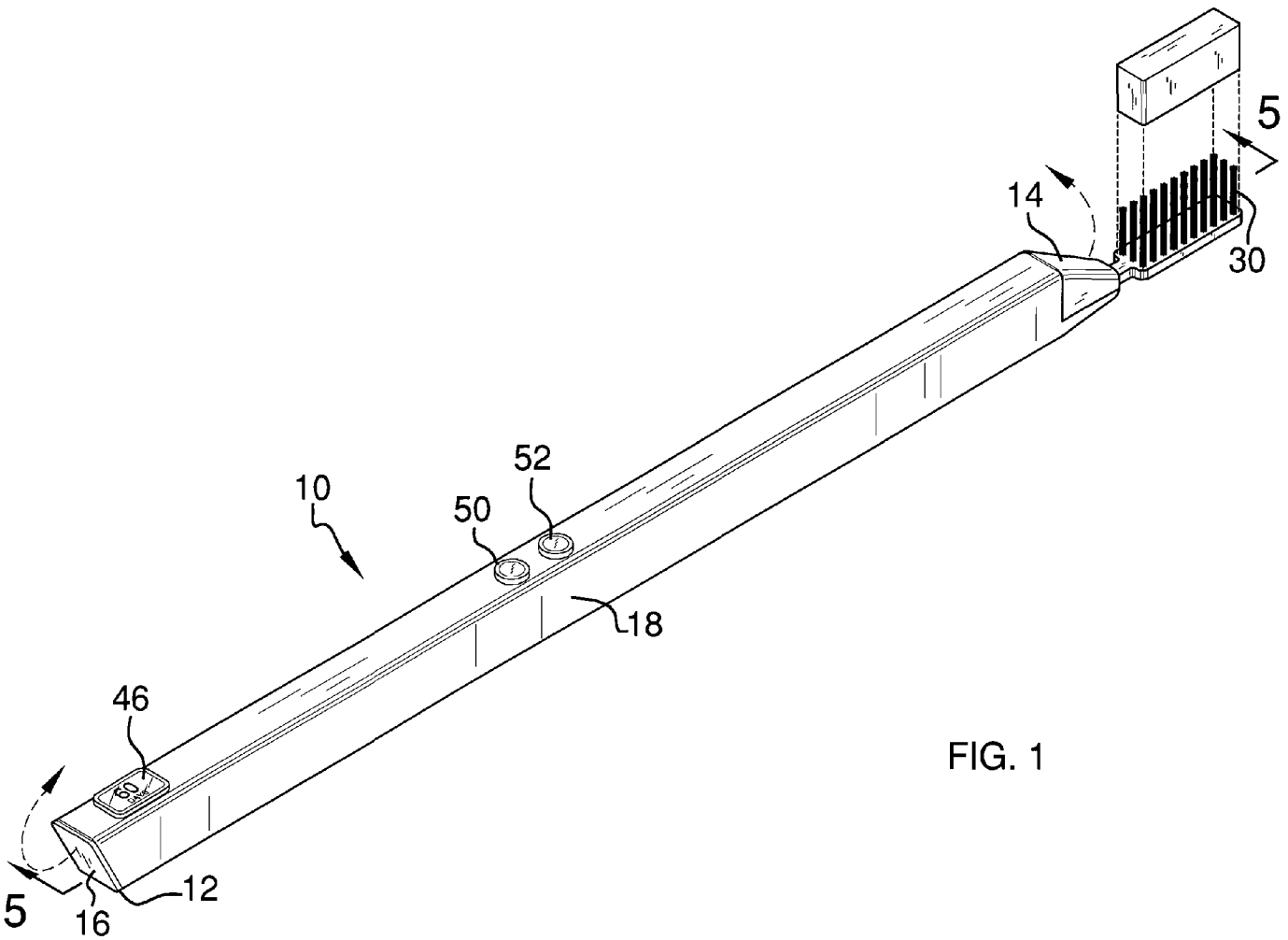
FIG. 1 is a top perspective view of a multi-head toothbrush assembly according to an embodiment of the disclosure.

With reference now to the drawings, and in particular to FIGS. 1 through 9 thereof, a new toothbrush device embodying the principles and concepts of an embodiment of the disclosure and generally designated by the reference numeral 10 will be described.

As best illustrated in FIGS. 1 through 9, the multi-head toothbrush assembly 10 generally comprises a housing 12 that is elongated and has a first end 14, a second end 16 and a perimeter wall 18 attached to and extending between the first 14 and second 16 ends. The first end 14 comprises an exit door configured for opening or closing the first end 14. The second end 16 comprises a fill door configured for opening or closing the second end 16. The exit and fill doors may be held in place by any conventional lock including a friction latch or other similar structure. The perimeter wall 18 includes a bottom wall 20 and a top wall 22.

Figure 2:
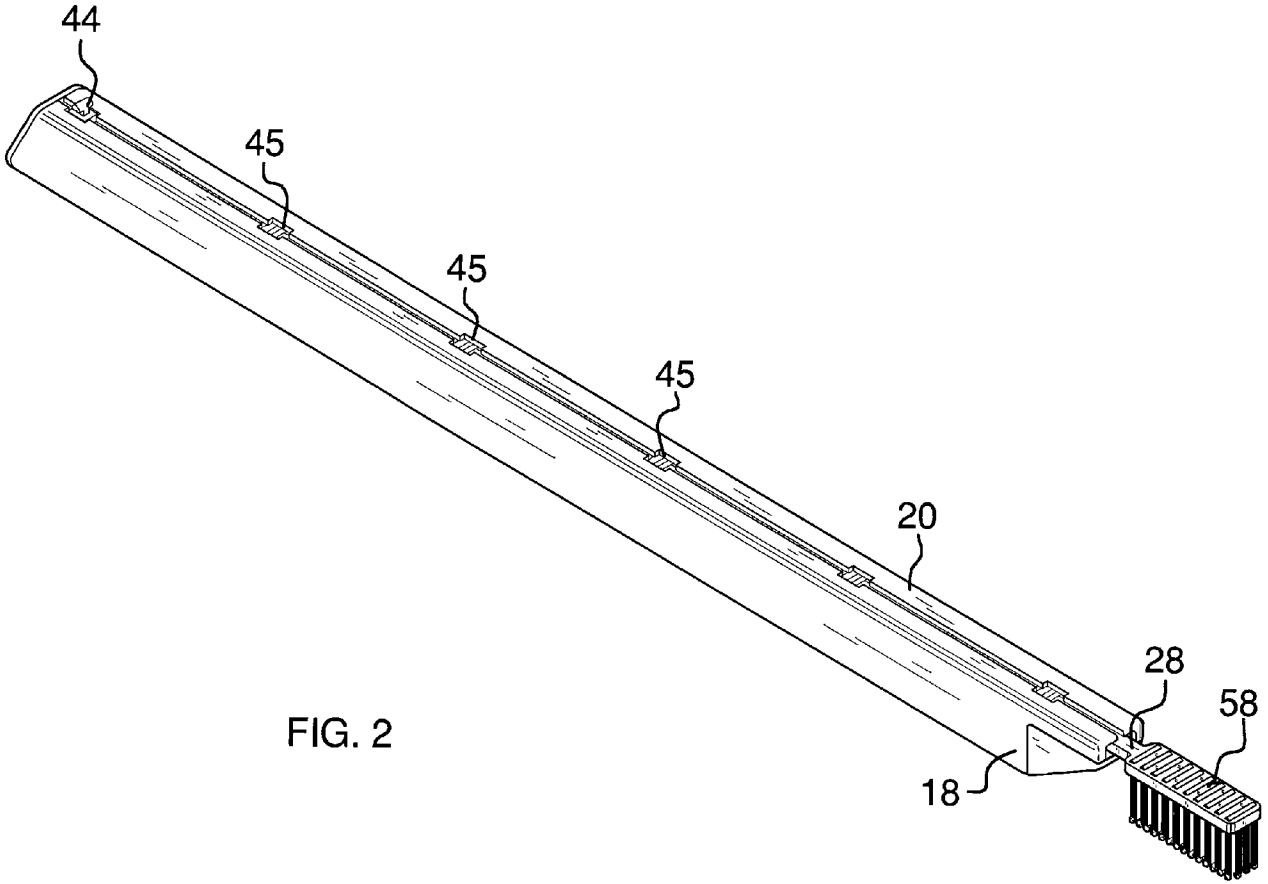
FIG. 2 is a bottom perspective view of an embodiment of the disclosure.
Figure 3:
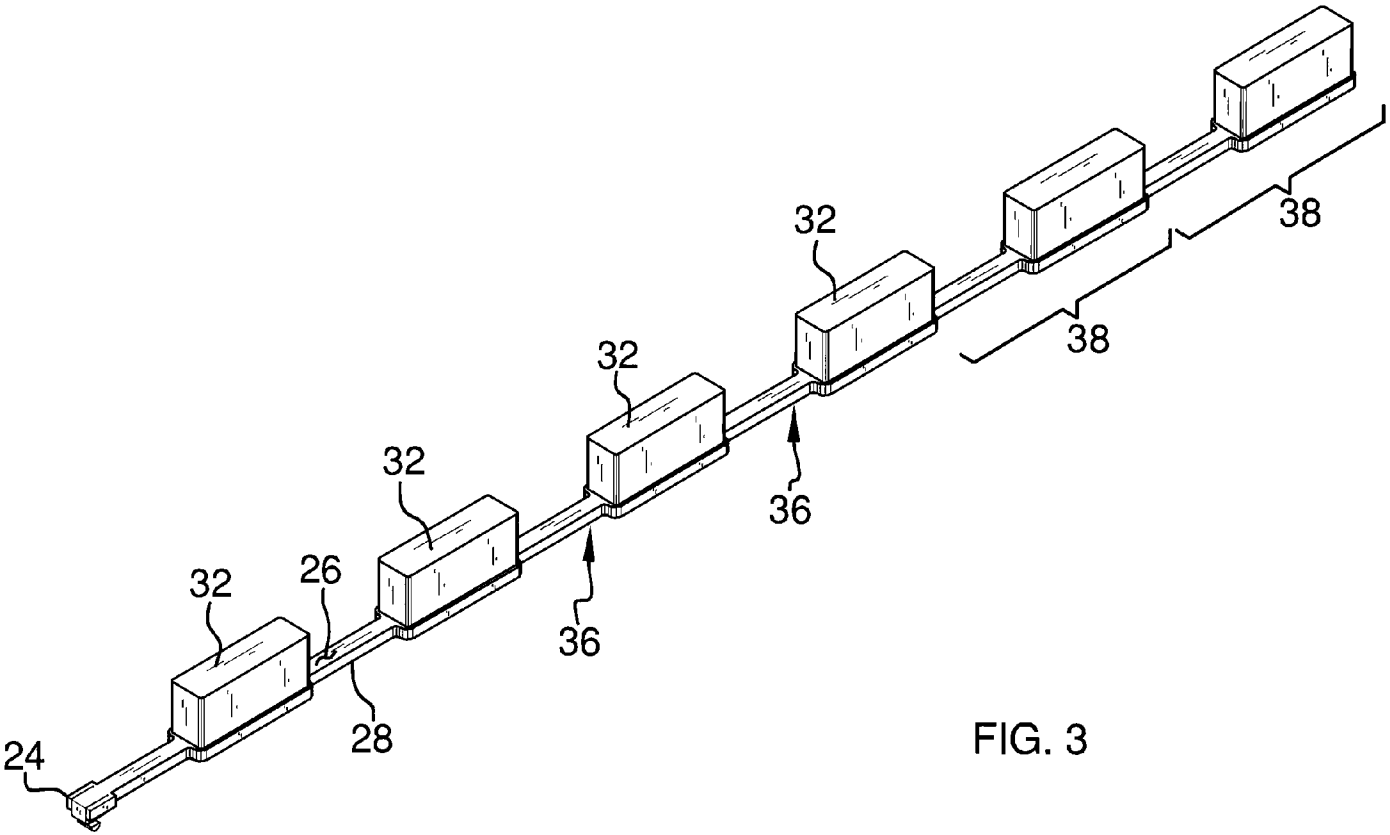
FIG. 3 is a top perspective view of an embodiment of the disclosure.
Figure 4:
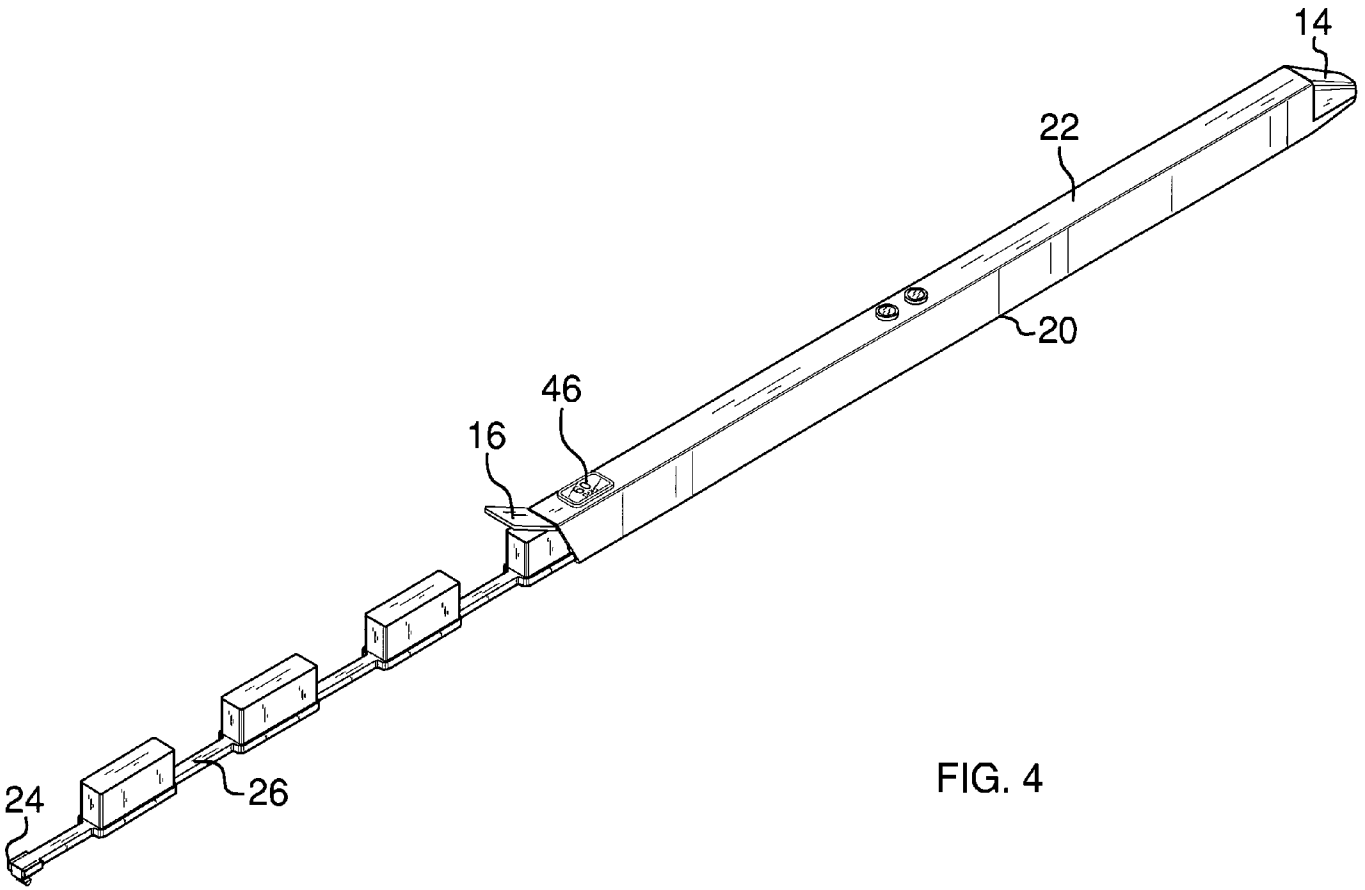
FIG. 4 is a top perspective view of an embodiment of the disclosure.
Figure 5:
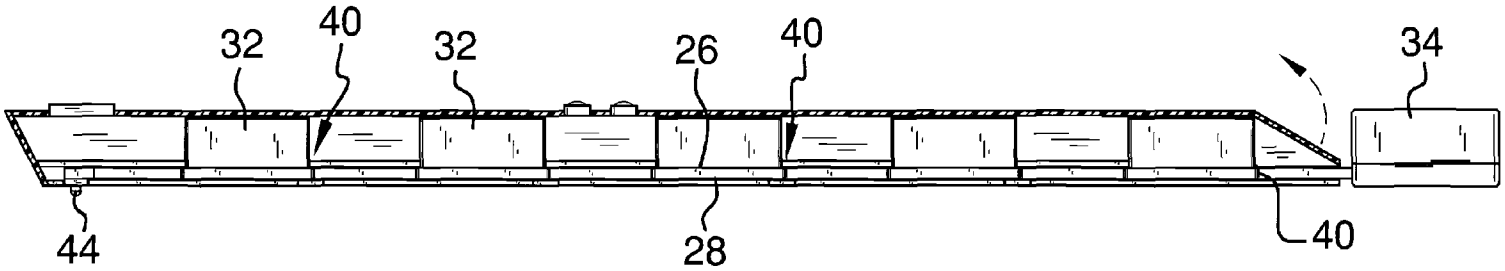
FIG. 5 is a cross-sectional view of an embodiment of the disclosure taken along line 5-5 of FIG. 1.
Figure 6:
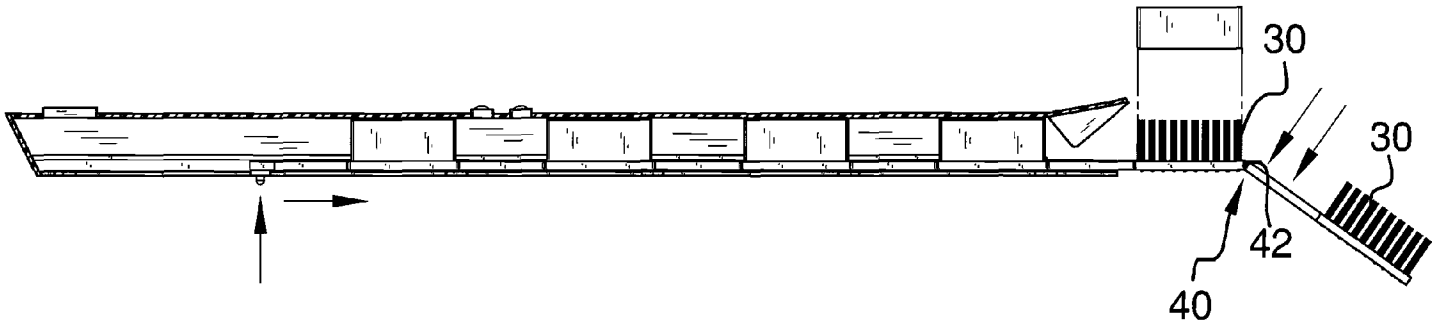
FIG. 6 is a cross-sectional view of an embodiment of the disclosure.

An elongated panel 24 has a top side 26 and a bottom side 28. The panel 24 may be comprised of a plastic material. A plurality of sets 30 of bristles is provided and each of the sets 30 is attached to and extends upwardly from the top side 26. The sets 30 are spaced from each other. A plurality of wrappers 32 is provided and each of the sets 30 has one of the wrappers 32 positioned thereon. The wrappers 32 are removable before the sets 30 are used. A cap 34 may be provided to cover an exposed one of the sets 30 of bristles though such may not be necessary is described below. A plurality of panel sections 36 is defined between adjacent ones of the sets 30. Each of the panel sections 36 and an adjacent set 30 defines a head 38. As can be seen in FIG. 2, each head 38 may include roughed portion 58 to function as a tongue scraper. A frangible area 40 in the panel 12 is formed at junctures of each of the heads 38 to facilitate breaking of the panel 24 to allow the heads 38 to be broken off from each other. The term "frangible" is used to here to mean that less than ½ of the force is required to break the panel 24 in the frangible areas 40 than other parts of the panel 24. This may be accomplished by notches 42 positioned in the panel 24.

The panel 24 is slidable outwardly through the first end 14 to expose the one of the heads 38 to allow the exposed one of the heads 38 to be used for brushing teeth. The heads 38 are broken off of the panel 24 to allow a next one of the heads 24 to be used. When all of the heads 24 are used, a new collection of attached heads is inserted through the fill door, or second end 16. If the assembly 10 is to be travelled with, the user may move an exposed head 38 back into the housing 12. This would remove the need to use the cap 34 as indicated above.

A stop 44 may be attached to the panel 24 and is positioned on a last one of the heads 38. The last one of the heads 38 would be the head 38 nearest to the second end 16. The stop 44 is extendable through one of a plurality of apertures 45 in the bottom wall 20 to restrict movement of the panel 24 when the stop 44 is positioned in one of the apertures 45. The stop 44 is moved to different ones of the apertures 45 as the panel 24 is extended through the first end 14. The stop 44 is simply pushed upwardly though the bottom wall 20 and into the housing 12 when the panel 24 is to be moved. The stop 44 prevents the panel 24 from sliding back and forth within the housing 12. The wrappers 32 assist in allowing the heads 38 to slide through the housing 12 while preventing damage to bristles as well as keeping them free of bacteria, contaminants and the like.

A display 46 may be mounted on the housing 12. The display 46 is actuated to count down a preselected amount of time to indicate how long a person should brush their teeth.

This time is typically between about 90 seconds and 210 seconds. A control circuit 48 is mounted to the housing 12. The display 46 may be electrically coupled to the control circuit 48. The display 46 may be actuated to count down the preselected amount of time by an actuation button embedded in the display, for instance, or may be actuated by a motion sensor coupled to the control circuit. However, any conventional actuation may be utilized.

A renew light emitter 50 is electrically coupled to the control circuit 48. The control circuit 48 is programmed to track a renewal time. The renewal time is generally between one month and three months and in particular about two months. The renew light 50 is turned on when the renewal time has elapsed. The renew light 50 provides an indicator to the user of the assembly 10 that the current, exposed head 38 should be removed. A replace light 52 may also be mounted on the housing 12 and electrically coupled to the control circuit 48. The replace light 52 may be actuated to an on position to emit light once the control circuit 48 has determined that the renew light 50 has been turned on a number of times equal to the number of heads 38 originally provided. Alternatively, a trip switch, not shown, may be positioned within the housing 12 that is released once the panel 24 is not long enough to engage the trip switch due to the fact that only one head 38 remains. Each of the renew 50 and replace 52 lights may also include integrated actuators so that depressing either will actuate them to a non-illuminated off condition.

Figure 8:
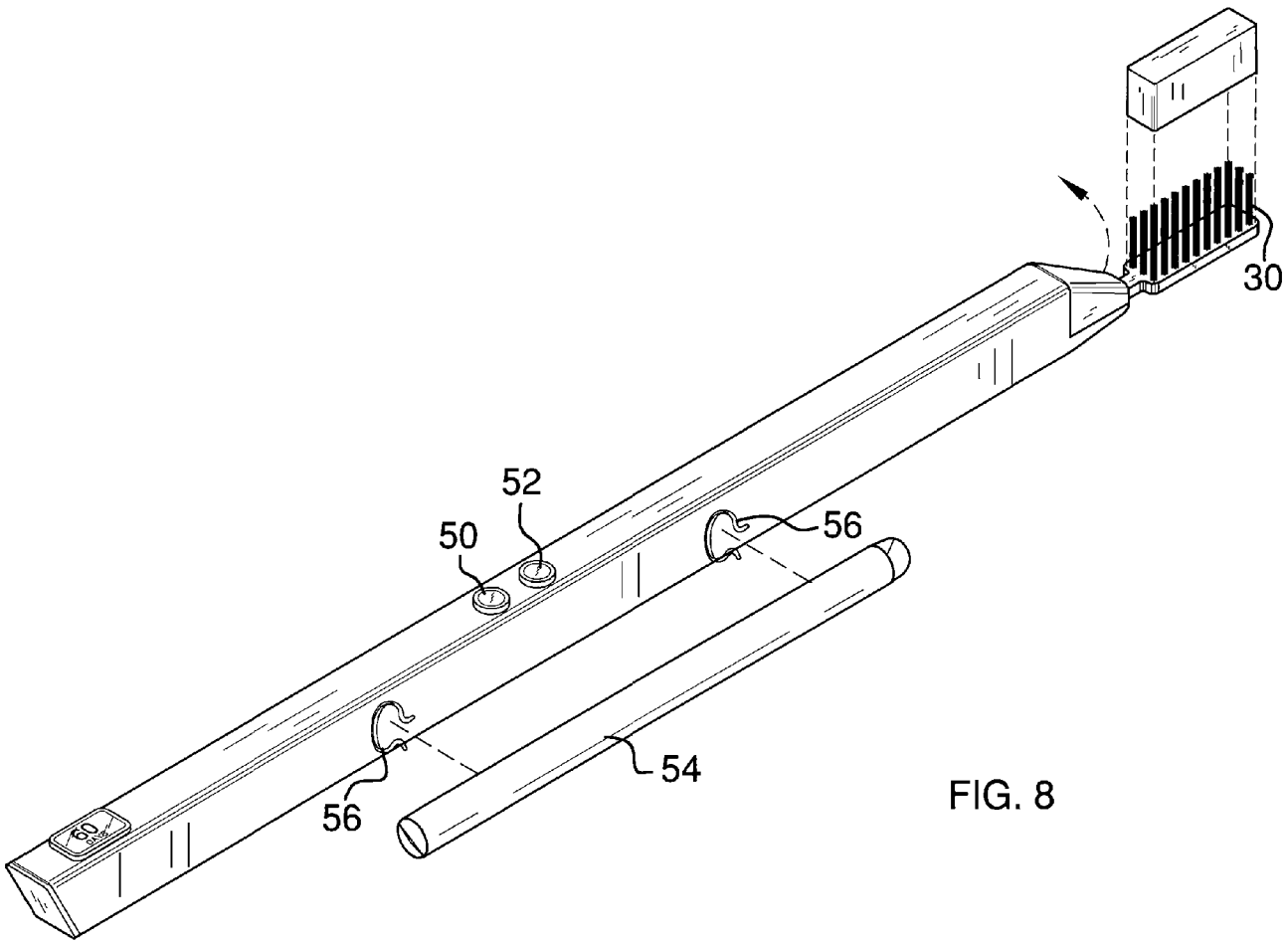
FIG. 8 is a top perspective view of an embodiment of the disclosure.
Figure 7:
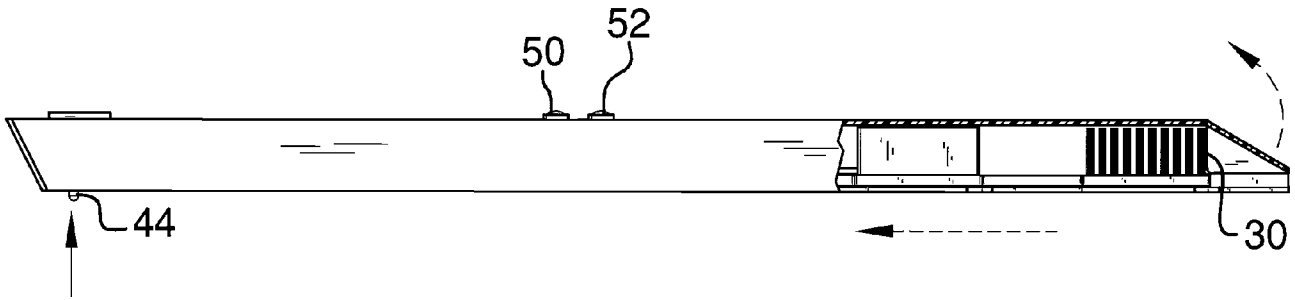
FIG. 7 is a side broken view of an embodiment of the disclosure.
Figure 9:
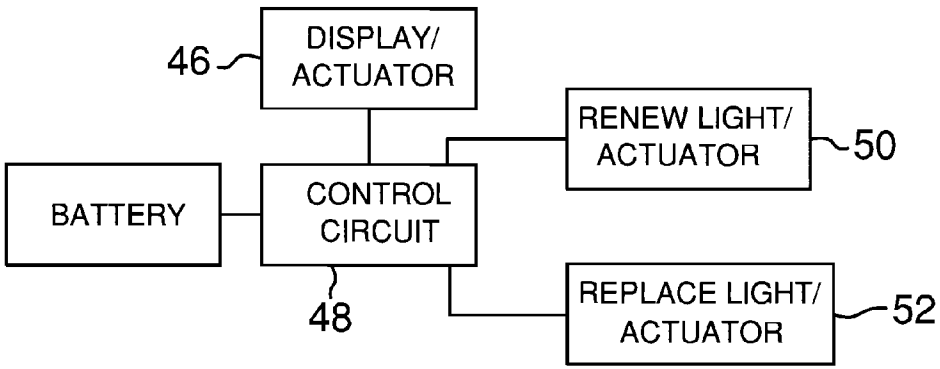
FIG. 9 is a schematic view of an embodiment of the disclosure.

As can be seen in FIG. 8, the assembly 10 may include a toothpaste dispenser 54 for providing toothpaste as needed and in particular for a traveler. Such a dispenser 54 will preferably be elongated, having a length greater than 4.0 cm but being relatively narrow and having a greatest width being less than 1.0 cm. The dispenser 54 may be tubular shaped as shown in FIG. 8 and attached to the housing with clips 56.

In use, the assembly 10 is used in a conventional manner to allow a person to brush their teeth. However, when a head 38 has become worn or old, it may simply be broken off a remaining part of the panel 24 and a new head 38 extended outwardly of the housing 12. The display 46 will help a person realize the length of time that they are brushing their teeth while the renew light 50 will ensure that a head 38 is not used for too long of a time period.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

We claim:

1. A toothbrush assembly comprising:

a housing being elongated and having a first end, a second end and a perimeter wall being attached to and extending between said first and second ends, said first end comprising an exit door configured for opening or closing said first end;

an elongated panel having a top side and a bottom side;

a plurality of sets of bristles, each of said sets being attached to and extending upwardly from said top side, said sets being spaced from each other;

a plurality of panel sections being defined between adjacent ones of said sets, each of said panel sections and an adjacent set defining a head, a frangible area in said panel being formed at junctures of each of said heads to facilitate breaking of said panel to allow said heads to be broken off from each other;

said panel being slidable outwardly through said first end to expose one of said heads to allow an exposed one of said heads to be used for brushing teeth, said exposed one of said heads being broken off of said panel to allow a next one of said heads to be used; and a stop being attached to said panel and being positioned on a last one of said heads, said stop being extendable through one of a plurality of apertures in said bottom wall to restrict movement of said panel when said stop is positioned in one of said apertures, said stop being moved to different ones of said apertures as said panel is extended through said first end.

2. The assembly according to claim 1, further including a display being mounted on said housing, said display being actuated to count down a preselected amount of time to indicate how long a person should brush their teeth.

3. The assembly according to claim 1, further including a control circuit being mounted to said housing, a renew light emitter being electrically coupled to said control circuit, said control circuit being programmed to track a renewal time, said renewal time being at least one month, said renew light being turned on when the renewal time has elapsed.

4. The assembly according to claim 1, further including a plurality of wrappers, each of said sets having one of said wrappers positioned thereon and being removable before said sets are used.

5. A toothbrush assembly comprising:

a housing being elongated and having a first end, a second end and a perimeter wall being attached to and extending between said first and second ends, said first end comprising an exit door configured for opening or closing said first end, said second end comprising a fill door configured for opening or closing said second end, said perimeter wall including a bottom wall and a top wall;

an elongated panel having a top side and a bottom side;

a plurality of sets of bristles, each of said sets being attached to and extending upwardly from said top side, said sets being spaced from each other;

a plurality of panel sections being defined between adjacent ones of said sets, each of said panel sections and an adjacent set defining a head, a frangible area in said panel being formed at junctures of each of said heads to facilitate breaking of said panel to allow said heads to be broken off from each other;

said panel being slidable outwardly through said first end to expose said heads to allow said heads to be used for brushing teeth, said heads being broken off of said panel to allow a next one of said heads to be used;

a stop being attached to said panel and being positioned on a last one of said heads, said stop being extendable through one of a plurality of apertures in said bottom wall to restrict movement of said panel when said stop is positioned in one of said apertures, said stop being moved to different ones of said apertures as said panel is extended through said first end;

a display being mounted on said housing, said display being actuated to count down a preselected amount of time to indicate how long a person should brush their teeth;

a control circuit being mounted to said housing, a renew light emitter being electrically coupled to said control circuit, said control circuit being programmed to track a renewal time, said renewal time being at least one month, said renew light being turned on when the renewal time has elapsed; and a plurality of wrappers, each of said sets having one of said wrappers positioned thereon and being removable before said sets are used.

6. A toothbrush assembly comprising:

a housing being elongated and having a first end, a second end and a perimeter wall being attached to and extending between said first and second ends, said first end comprising an exit door configured for opening or closing said first end;

an elongated panel having a top side and a bottom side;

a plurality of sets of bristles, each of said sets being attached to and extending upwardly from said top side, said sets being spaced from each other;

a plurality of panel sections being defined between adjacent ones of said sets, each of said panel sections and an adjacent set defining a head, a frangible area in said panel being formed at junctures of each of said heads to facilitate breaking of said panel to allow said heads to be broken off from each other;

said panel being slidable outwardly through said first end to expose one of said heads to allow an exposed one of said heads to be used for brushing teeth, said exposed one of said heads being broken off of said panel to allow a next one of said heads to be used; and a control circuit being mounted to said housing, a renew light emitter being electrically coupled to said control circuit, said control circuit being programmed to track a renewal time, said renewal time being at least one month, said renew light being turned on when the renewal time has elapsed.

7. The assembly according to claim 6, further including a display being mounted on said housing, said display being actuated to count down a preselected amount of time to indicate how long a person should brush their teeth.

8. The assembly according to claim 6, further including a plurality of wrappers, each of said sets having one of said wrappers positioned thereon and being removable before said sets are used.

* * * * *